US007751531B2

(12) United States Patent
Liu et al.

(10) Patent No.: US 7,751,531 B2
(45) Date of Patent: Jul. 6, 2010

(54) STANDING WAVE ELECTRON LINEAR ACCELERATOR AND INSTALLATION ADJUSTING DEVICE THEREOF

(75) Inventors: Yaohong Liu, Beijing (CN); Chuanxiang Tang, Beijing (CN); Yuanjing Li, Beijing (CN); Jinsheng Liu, Beijing (CN); Wei Jia, Beijing (CN); Jianjun Gao, Beijing (CN); Huaping Tang, Beijing (CN); Chong Gu, Beijing (CN); Wei Yin, Beijing (CN); Dan Zhang, Beijing (CN); Qinghui Zhang, Beijing (CN)

(73) Assignees: Nuctech Company Limited, Beijing (CN); Tsinghua University, Beijing (CN)

( * ) Notice: Subject to any disclaimer, the term of this patent is extended or adjusted under 35 U.S.C. 154(b) by 228 days.

(21) Appl. No.: 11/997,442
(22) PCT Filed: Dec. 25, 2006
(86) PCT No.: PCT/CN2006/003575

§ 371 (c)(1),
(2), (4) Date: Feb. 27, 2008

(87) PCT Pub. No.: WO2008/046262

PCT Pub. Date: Apr. 24, 2008

(65) Prior Publication Data

US 2010/0002843 A1 Jan. 7, 2010

(30) Foreign Application Priority Data

Oct. 13, 2006 (CN) ..... 2006 1 0113718

(51) Int. Cl.
*H01J 35/14* (2006.01)

(52) U.S. Cl. ..... 378/138

(58) Field of Classification Search ..... 378/57, 378/58, 65, 143, 137, 138; 250/251; 315/505, 315/500, 5.41
See application file for complete search history.

(56) References Cited

U.S. PATENT DOCUMENTS 5,744,919 A 4/1998 Mishin et al. ..... 315/505
7,391,849 B2 * 6/2008 Smith ..... 378/109

FOREIGN PATENT DOCUMENTS

CN 1482844 3/2004
WO WO 2004/030162 4/2004

OTHER PUBLICATIONS

"International Search Report and written Opinion", PCT/CN2006/003575.

* cited by examiner

*Primary Examiner*—Irakli Kiknadze
(74) *Attorney, Agent, or Firm*—Westman, Champlin & Kelly, P.A.

(57) ABSTRACT

The present invention discloses a standing wave linear accelerator, comprising: a microwave device configured to generate microwave; an electron beam emitting device configured to emit electron beam; an accelerating device configured to receive the microwave generated by the microwave device and form a microwave electric field, to accelerate electron beams generated from the electron beam emitting device and undertake the accelerated electron beam targeting to emit X ray beam; a synchronous device generating synchronous pulse signal; and a quick beam emitting device receiving the synchronous pulse signal generated by the synchronous device, wherein the microwave device runs and generates microwave in advance before the operation of the electron beam emitting device based on the synchronous pulse signal, and the quick beam emitting device drives the electron beam emitting device to emit electron beam after power of the microwave generated by the microwave device reaches stable state, so that the accelerating device emits X ray beam. In the accelerator, the microwave system and the electron beam emitting device do not work at the same time, and the accelerator electron beam emitting system is started only when the AFC is put into operation and runs stably.

13 Claims, 4 Drawing Sheets

STANDING WAVE ELECTRON LINEAR ACCELERATOR AND INSTALLATION ADJUSTING DEVICE THEREOF

CROSS-REFERENCE TO RELATED APPLICATION

This Application is a Section 371 National Stage Application of International Application No. PCT/CN2006/003575, filed Dec. 25, 2006 not yet published, the content of which is hereby incorporated by reference in its entirety

FIELD OF THE INVENTION

Embodiments of the present invention generally relates to a quick responsive standing wave electron linear accelerator and an installation adjusting device thereof, especially to a non-destructive inspection, radiating medical field with an accelerator capable of emitting X rays as a radiating source.

BACKGROUND OF INVENTION

FIG. 1 shows a block diagram comprising a conventional standing wave accelerator system. As shown in FIG. 1, a control system 1 emits a system synchronous pulse and a beam emitting instruction in turn. The beam emitting instruction is a high voltage applying one. After receiving the beam emitting instruction, a high voltage contactor turns on, a pulse modulator 2 for generating pulse signal generates a high voltage pulse based on a triggered control signal. The high voltage pulse is transferred to a pulse transformer 3 in the X ray device and further increases voltage by the pulse transformer, split into two high voltage branches for a microwave source (a magnetron 4) and a electron gun 6. The microwave source generates microwave under the first branch of pulse high voltage. The microwave is transferred to an accelerating tube 7 via a microwave transfer system, forming a stable accelerating electric field in the accelerating tube 7, meanwhile, the electron gun emits electron beam stream under another branch of pulse high voltage. The electron beam stream flows into the accelerating tube 7 and is accelerated by the accelerating electric field in the accelerating tube 7 to form high energy electron beam stream for final accelerated electron beam targeting. The X ray generated by the electron beam targeting forms a predetermined dosage output of the accelerator, so that it can be widely applied to non-destructive and radiating fields etc.

In the conventional working process of the standing wave accelerator system, the following loops are required from the emission of the accelerator beam emitting instruction to the stable dosage output of X ray generated by the accelerator:

1. Soft Startup

To protect the magnetron, the pulse high voltage generated by the pulse modulator increases gradually rather than up to fill load at startup. Approximately 500 ms elapses from the generation of pulse high voltage to full load. Corresponding to this, the dosage output of X ray generated by the accelerator increases slowly.

2. AFC Frequency Stabilization

When the accelerator emits radiating beam, especially when the repeated frequency is high, the temperature of the accelerating tube changes due to the inner microwave power, and the temperature change of the accelerator leads to the variation of the characteristic frequency. The output frequency of the magnetron is ensured to be consistent with the characteristic frequency of the accelerating tube by an AFC (automatic frequency control) frequency stabilizing device in the standing wave accelerator system, to ensure the long time stable work of the accelerator system. The AFC frequency stabilizing device emits corresponding adjusting instructions by obtaining microwave information at different positions of the microwave transfer system and analyzing whether the output frequency of the magnetron is consistent with the characteristic frequency of the accelerating tube, so that the output frequency of the magnetron is consistent with the characteristic frequency of the accelerating tube by adjusting inner devices in the magnetron. When the accelerator starts to be applied high voltage and emit radiating beam, the microwave enters the accelerating tube formed with electric field, while the accelerating tube consumes power with temperature changing which leads to characteristic frequency changing. The AFC frequency stabilizing device is put into operation and the system is stabilized by repeated adjustment thereof, thus forming stable dosage output. This process needs time which normally falls in the range of 500 ms to 5 s.

FIG. 2 is a timing chart of FIG. 1 corresponding to conventional accelerator. From the timing chart of FIG. 2, an accelerator beam stream pulse stabilizing time T3 is the sum of the soft startup time T1 and the AFC adjusting time T2.

Thus, due to the existence of the loops of soft startup and the AFC frequency stabilizing etc., the time from the sending of beam emitting instruction of the accelerator to the stable dosage output of the accelerator normally requires 0.5 second to 5 seconds in the existing standing wave accelerator system. Since the time delay is long and not constant, it is not adapted to the circumstances where quick responsive accelerator is required, which is disadvantageous to the widely application of the standing wave accelerator.

The inventor develops and produces a container/large cargo inspection system with a standing wave electron linear accelerator. The design of the container/container truck rapid inspection system is that the vehicle to be inspected can pass through an inspection passage continuously and rapidly. After the system dodges the vehicle head part, beam emitting instruction is instructed to the accelerator, requiring that there is no dosage output of radiating beam when the system dodges the vehicle head to ensure the safety of the driver And when beam emitting instruction is indicated, stable dosage output is immediately formed, thereby timely and thoroughly inspecting a cargo cabinet area. The responsive time normally falls within 100 ms. Therefore, the system requires a novel accelerator system as a radiating source which is capable of rapid response.

SUMMARY OF THE INVENTION

To overcome defects in conventional art, an object of the invention is to provide a quick responsive standing wave electron linear accelerator, a rapid beam emitting control method thereof and an installation adjusting device thereof. A microwave power system operates prior to an electron gun power system to achieve the object of quick response.

To achieve the above objects, the present invention is provided, that is, a standing wave linear accelerator is provided, comprising: a microwave device configured to generate microwave; an electron beam emitting device configured to emit electron beam; an accelerating device configured to receive the microwave generated by the microwave device and form a microwave electric field, to accelerate electron beams generated from the electron beam emitting device and undertake the accelerated electron beam targeting to emit X ray beam; a synchronous device generating synchronous pulse signal; and a quick beam emitting device receiving the synchronous pulse signal generated by the synchronous device, wherein the microwave device runs and generates microwave in advance before the operation of the electron beam emitting device based on the synchronous pulse signal, and the quick beam emitting device drives the electron beam emitting device to emit electron beam after power of the microwave generated by the microwave device reaches stable state, so that the accelerating device emits X ray beam.

When the standing wave electron linear accelerator works, the high voltage applying instruction and a beam emitting instruction are separated. The system gives high voltage applying instruction firstly, and the microwave power system starts to work, that is, a modulator generates high voltage when the control device gives high voltage applying instruction. The pulse high voltage is increased to be magnetron pulse high pressure by a pulse transformer. The magnetron generates microwave under pulse high voltage. The microwave reaches the accelerating tube via a microwave transfer system and forms a standing wave accelerating electric field in the accelerating tube. AFC frequency stabilizing device starts to work, so that the microwave output frequency of the magnetron is consistent with the characteristic frequency of the accelerating tube and the whole system gradually reaches to a microwave power stable state. The control system emits beam emitting instruction based on the applying circumstances, the electron gun power system starts to work, that is, the electron gun triggering control device generates an electron gun triggering pulse due to the beam emitting instruction. The electron gun pulse power supply generates an electron gun pulse with the electron gun triggering pulse. And the electron gun pulse is increased in voltage to form an electron gun high voltage pulse by an electron gun pulse transformer, the electron gun high voltage pulse is applied to the electron gun to generate electron beam stream. The electron beam stream is acted upon by the stable standing wave accelerating electric field in the accelerating tube, and is accelerated and targeted to form stable dosage output.

The responsive speed in the standing wave electron linear accelerator of the invention is dependent on the electron gun power supply system rather than the microwave power supply system. The whole system has quick responsive function by applying high voltage with the electron gun to achieve stable quick responsive attribute. With experimentation, the time from the emission of a beam emitting instruction to the stabilization of the X ray beam emitted from the accelerator falls within 100 ms in the quick responsive standing wave electron linear accelerator of the invention.

The quick responsive standing wave electron linear accelerator of the invention can precisely controls the working manner of the electron gun because the process of emitting the X ray beam is controlled by the electron gun power supply, so that the X ray beam of micro dosage can be achieved. And the X ray beam of micro dosage have great prospect to be applied in radiating medical field. By controlling precisely radiating dosage, the utilization ratio and effectiveness of irradiation dosage can be enhanced to decrease over-irradiation or fault irradiation of patient.

The invention further provides a container/container truck quick inspection system. The vehicle head can be effectively dodged with the quick responsive standing wave electron linear accelerator of the invention as a radiating source, and the vehicle cargo cabinet area can be thoroughly inspected to ensure the safety of the driver while the overall effectiveness of the inspection can be achieved. Especially using the quick responsive feature of the invention, the container/container truck quick inspection system can inspect a queue of vehicle in a continuous and rapid manner. The vehicle queue can be inspected with a speed of 1-4 m/s passing through the passage, thus increasing vehicle inspection efficiency. And the time for inspecting a container truck is shortened from former 2-3 minutes to existing 10 seconds or less.

The quick responsive standing wave electron linear accelerator of the invention as a radiating source can also be applied to a radiating system with a particular requirement for partial radiation to the products on a transmission line, thus solving the problem for some product which can not be divided whereas a part thereof should be radiated and other part should not be radiated.

BRIEF DESCRIPTION OF THE DRAWING

These and/or other aspects and advantages of the present invention will be more readily apparent from the following detailed description of preferred embodiments when taken together with the accompanying drawings.

DETAILED DESCRIPTION OF THE PREFERRED EMBODIMENTS

Figure 1:
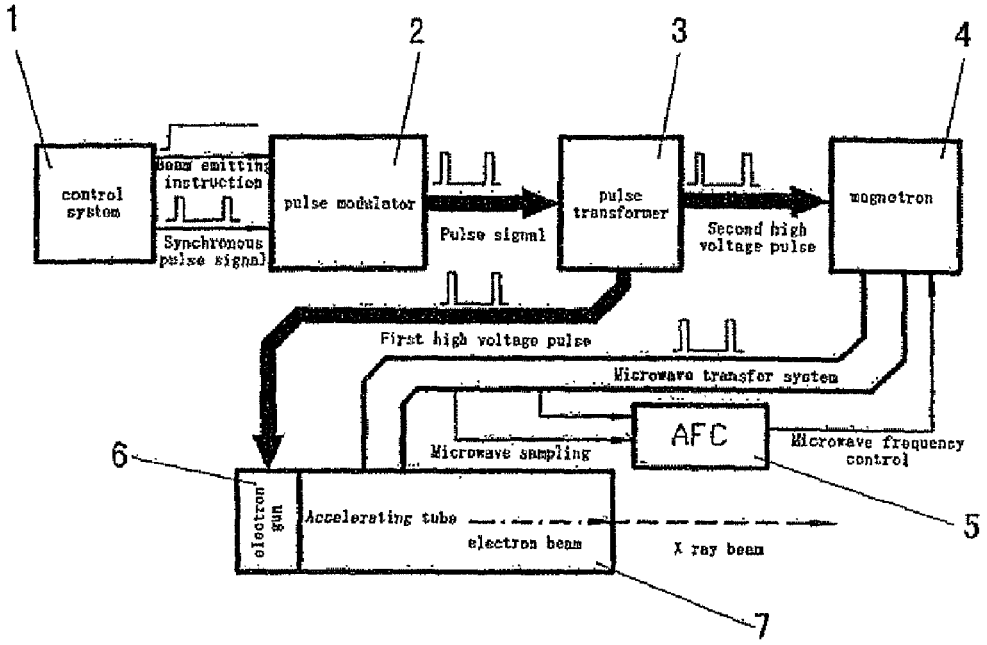
FIG. 1 is a component block diagram of a conventional accelerator.
Figure 2:
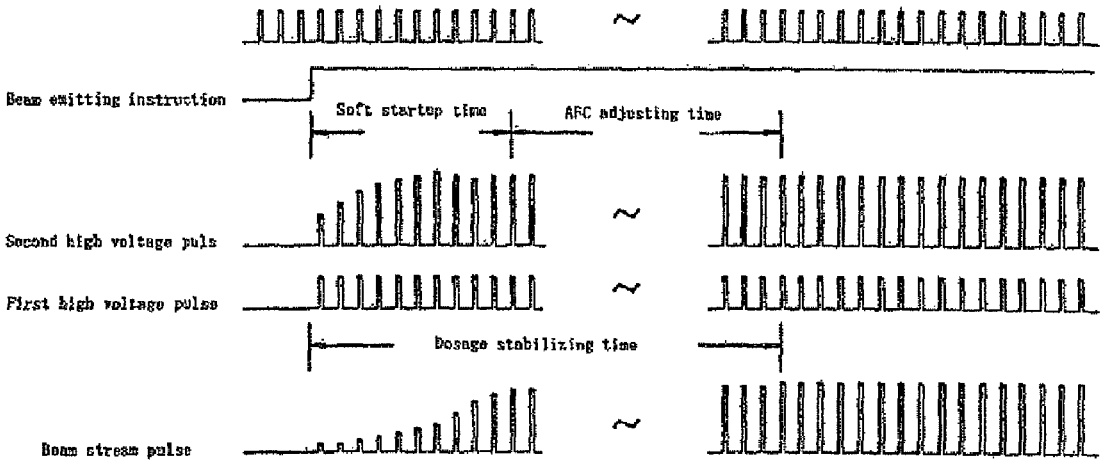
FIG. 2 is a timing chart corresponding to the conventional accelerator in FIG. 1.

Reference will now be made in detail to the embodiment of the present invention, examples of which are illustrated in the accompanying drawings, wherein like reference numerals refer to the like elements throughout. The embodiments are described below to explain the present invention by referring to the figures.

Figure 3:
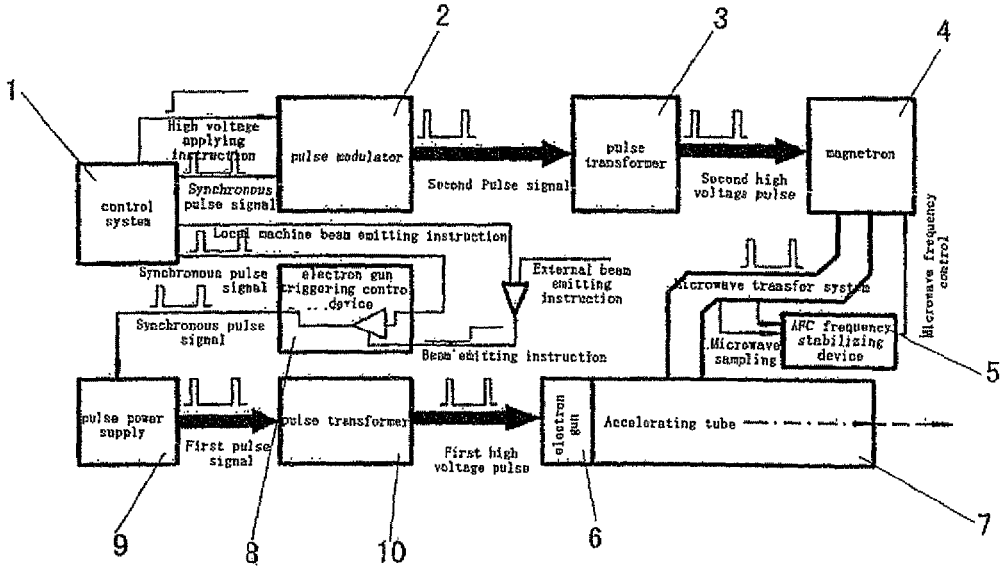
FIG. 3 is a component block diagram of an accelerator according to an aspect of the embodiment.

FIG. 3 is a component block diagram of an accelerator 200 according to an aspect of the embodiment in which an accelerator with a quick beam emitting device is shown. The accelerator may emit X ray beam so that it can be applied to cargo inspection system at road or harbor for X ray inspection to moving object such as moving vehicles etc. In FIG. 3, a standing wave linear accelerator according to the present invention comprises a microwave device 12 having a magnetron configured to generate microwave; an electron beam emitting device, such as an electron gun etc., configured to emit electron beam triggered by high voltage pulse; an accelerating device, such as an accelerating tube 7 etc., configured to receive the microwave generated by the magnetron 4 and transferred via a microwave transfer system to form a microwave electric field, and accelerate electron beams generated by the electron gun 10 with the microwave electric field and undertake the accelerated electron beam targeting to emit X ray beam with stable dosage; a synchronous device provided in a control system 1 for generating synchronous pulse signal which can be applied to a microwave device 12 so that the microwave device 12 generates microwave with corresponding frequency; and a quick beam emitting device 11 for receiving the synchronous pulse signal generated by the synchronous device. According to the invention, the microwave device 12 operates and generates microwave in advance before the operation of the electron gun 10, and the quick beam emitting device 11 drives the electron gun to emit electron beam after the microwave power generated by the microwave device 12 reaches stable state, so that the accelerating device emits X ray beam.

Further, the quick beam emitting device 11 may include an electron gun triggering control device 8 and a pulse device between the synchronous device and the electron gun, the pulse device includes a pulse power supply 9 and a pulse transformer 10. The electron gun triggering control device receives the synchronous pulse signal emitted by the synchronous device in the control system 1 and an enable signal for starting the electron gun 6, the enable signal can be enabled based on the local machine beam emitting instruction from the control system 1, and it can also be enabled by outer beam emitting instruction from other external operating mechanisms based on the microwave power stable state generated by the magnetron 4. Alternatively, it can be enabled when both conditions occur. When the enable signal is enabled, the pulse power supply 9 is started to generate a first pulse signal. The pulse transformer 10 transforms the first pulse signal generated by the pulse power supply 9 into a first high voltage pulse, so that the electron gun 6 is driven by the first high voltage electron gun 6 to emit electron beam.

Further, the microwave 12 includes a microwave pulse device, a microwave source such as a magnetron 4 etc. and a microwave transfer system. The microwave pulse device includes a modulator 2 and a pulse transformer 3. The modulator 2 receives a system synchronous pulse signal of the synchronous device and generates a second pulse signal. The pulse transformer 3 transforms the second pulse signal into a second high voltage pulse for driving the magnetron. The magnetron receives the second high voltage pulse and generates a microwave signal. The microwave transfer system transfers the microwave to an accelerating tube 6 to form a microwave electric field in the accelerating tube 6. Furthermore, the microwave device 12 her includes an AFC (automatic frequency control) frequency stabilizing device 5. The AFC frequency stabilizing device 5 is configured to consist a microwave output frequency of the microwave source with a high voltage pulse frequency (i.e. characteristic frequency) of the accelerating device for driving the electron gun 10.

The operation of the standing wave linear accelerator 200 of the invention would be described in the following.

The synchronous device in the control system 1 generates a system synchronous pulse signal and a high voltage applying signal to the pulse modulator 2. The pulse modulator 2 outputs the second pulse signal to the pulse transformer 3. The pulse transformer 3 increases the voltage of the second pulse signal to be a second high voltage pulse which is outputted to the magnetron 4. The magnetron 4 generates pulse microwave by the second high voltage pulse and feeds the same in the accelerating tube 7 via the microwave transfer system. The microwave forms a stable standing wave accelerating electric field in the accelerating tube 7 under the control of the AFC frequency stabilizing device 5. Meanwhile, the first high voltage signal for the electron gun 6 is not provided by the pulse transformer 3 any more. Rather, the synchronous pulse signal generated by the synchronous device in the control system 1 which has the same phase with the system and synchronizes with the system is provided to the electron gun triggering control device 8. The electron gun triggering control device 8 outputs the synchronous pulse signal to the pulse power supply 9 when beam emitting instruction (i.e. enable signal) is received. The pulse power supply 9 generates a first pulse signal based on the synchronous pulse signal. And the first pulse signal is transformed into a first high voltage pulse for the electron gun 6 by the pulse transformer 10. The electron gun 6 emits electron beam under the high voltage of the pulse. The electron beam is accelerated by the stable microwave electric field in the accelerating tube 7 and undertakes the accelerated electron beam targeting for generating X ray.

Figure 4:
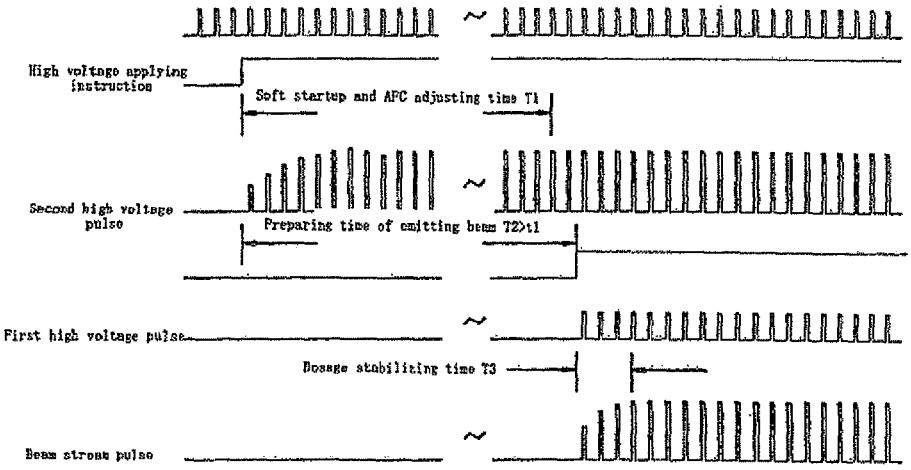
FIG. 4 is a timing chart corresponding to a quick beam emitting device in FIG. 3.

FIG. 4 is a timing chart of the system shown in FIG. 3. In FIG. 4, the magnetron starts to operate after the control system emits high voltage applying instruction. Compared with the conventional system, the difference lies in that the accelerator of the present invention does not generates X ray stream pulse at this time. After a period, normally 10 seconds, from the time when the control system generates the high voltage applying instruction, a stable accelerating electric field is formed in the accelerating tube after the system soft startup and the AFC frequency-stabilizing device is operated. At this time, beam emitting instruction is emitted as required. The beam emitting instruction can be generated by inner control system, and it can also be generated by external system. The beam emitting instruction starts the pulse power supply 9 with the electron gun triggering control device 8 and pulse electron beam is generated in the accelerating tube 7, which only requires a number of pulses, and the accelerator can obtain stable X ray pulse.

The container/container truck quick inspecting system of the present invention uses a standing wave linear accelerator 200 provided with a quick beam emitting device. Since the vehicle to be inspected quickly passes through the inspection passage and the safety of the driver should be protected when the vehicle is inspected, the accelerator generates beam emitting instruction (the enable signal for enabling the electron gun) after the vehicle head is dodged. The system requires the accelerator generating stable pulse beam stream after 100 ms when the enable signal is received. According to experimental data, the accelerator 200 outputs stable pulse beam stream after it receives 4 pulses of the enable signals from the electron gun (with the system normally working at 200 Hz, approximately 20 ms). The vehicle inspection efficiency is greatly enhanced with the accelerator system, the time for inspecting a container truck is shortened from former 2-3 minutes to existing 10 seconds or less.

The microwave system does not start working with the electron beam emitting system at the same time, that is, the microwave system starts working before the electron beam emitting system, and the accelerator electron beam emitting system is activated by the beam emitting instruction (the electron gun is enabled) for the accelerator emitting X ray beam after the AFC is put into operation and kept stable. With experimentation, the time from the emission of a beam emitting instruction to the stabilization of the X ray beam emitted from the accelerator falls within 100 ms.

Figure 5:
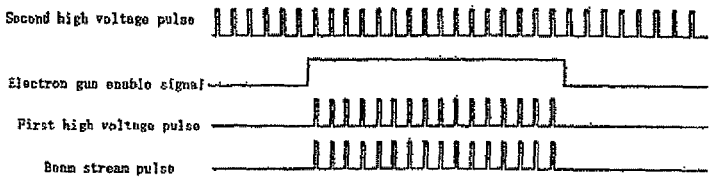
FIG. 5 is a control logic diagram of the accelerator in which the X ray beam is emitted with constant pulse in FIG. 3.

The present invention can also be applied to an accelerator system with fixed pulse beam emission. From the control logic of FIG. 5, the accelerator can be controlled to emit only several pulse beam stream. Since each pulse beam stream is very stable, the accelerator can relatively control the output dosage precisely The present invention has great prospect to be applied to mini-dosage imaging and medical therapy.

Figure 6:
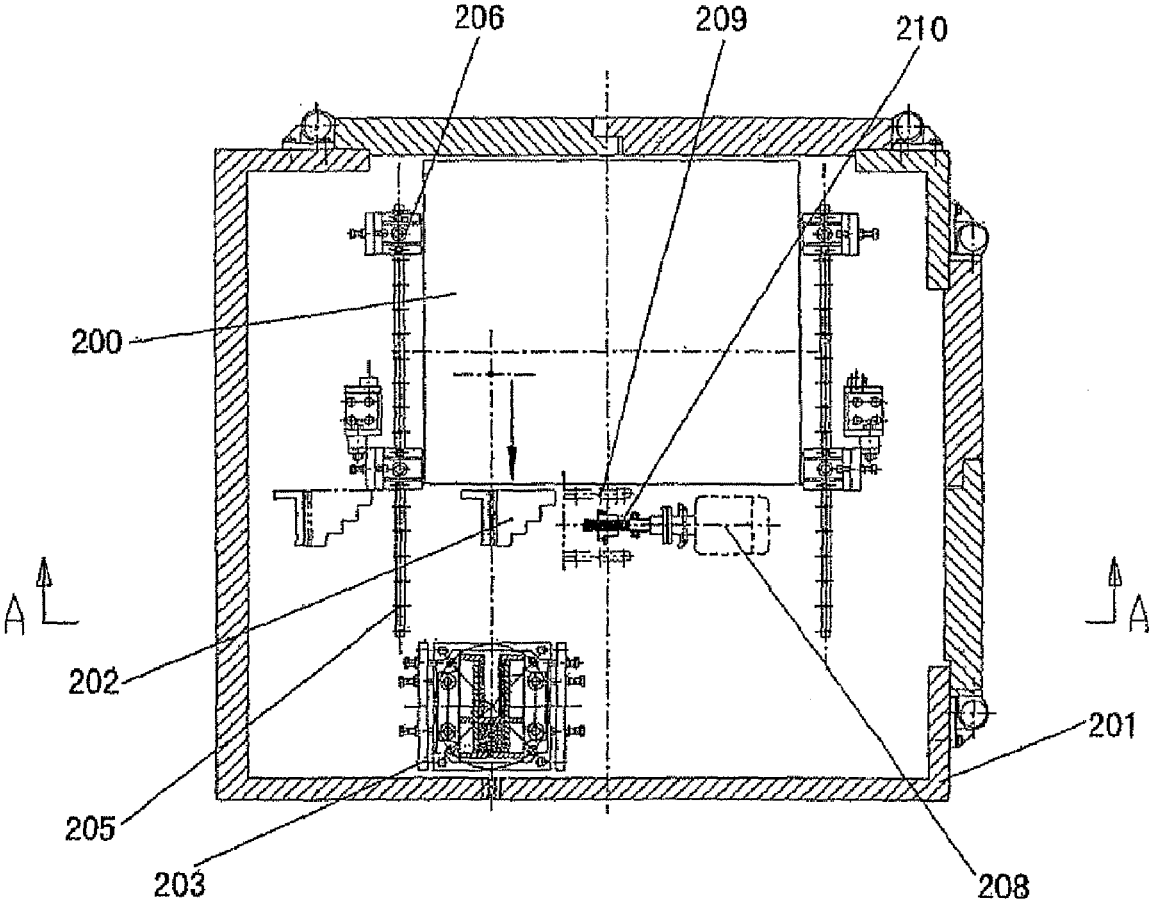
FIG. 6 is a schematic view of an accelerator installation adjusting device according to the invention.
Figure 7:
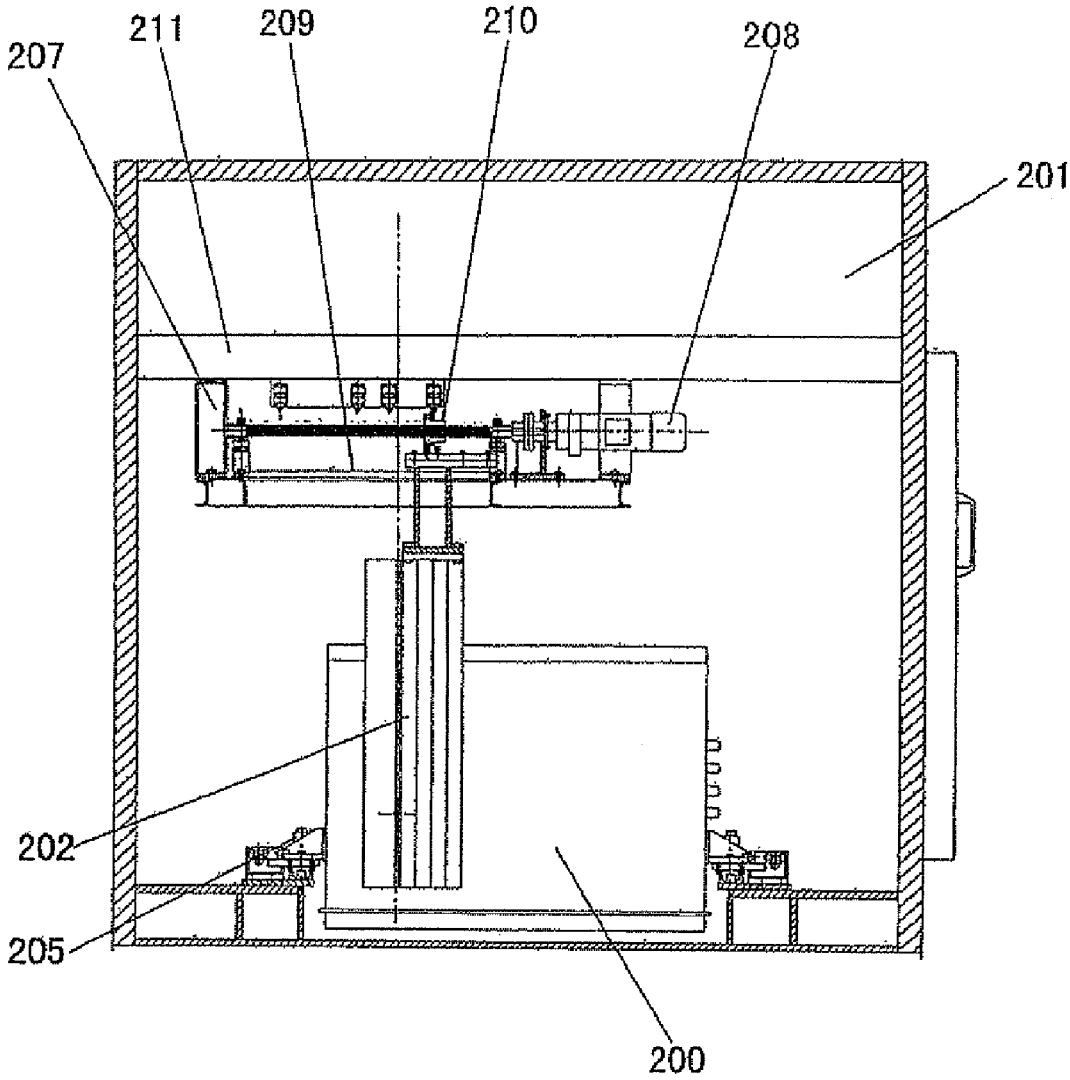
FIG. 7 is a schematic view taken along A-A line in FIG. 6.

Further, with reference to FIGS. 6 and 7, according to another aspect of the present invention, an accelerator installation adjusting device is provided, which comprises: a cabinet body 201 with radiation shield function; a standing wave linear accelerator 200 provided in the cabinet body 201; a rear collimator 202 with a correcting block, a front collimator 203 and a damping device 204 for damping the fixed accelerator 200. The rear collimator 202 is provided adjacent to the accelerator 200, and the front collimator is provided away from the accelerator 200 in the emitting direction of the radiating beam of the accelerator 200. Guiding rails 205 are arranged in parallel at both sides of the bottom in the cabinet body 201 in the emitting direction of the accelerator radiating beam, each guide rail 205 is provided with an adjustable damping device 206 which is connected with the accelerator 200. In normal case of operation, the damping device 206 fixes the accelerator 200 while the damping device 206 functions for damping when the accelerator 200 is moving. The accelerator 200 is provided at the back of the cabinet body 201, the beam emitting plane of the radiating beam thereof confronts with the front collimator 203 provided in front of the cabinet body 201. A moving mechanism 207 is provided at top of the cabinet body 201. The moving mechanism 207 is connected with the rear collimator 202 with a correcting block provided between the accelerator 200 and the front collimator 203.

When repaired, the moving mechanism 207 can transport the rear collimator 202 with the correcting block outside the guiding rails 205 juxtaposedly provided in front and rear linear manner, then the damping devices 206 are loosened so that the accelerator 206 can move along the guide rails rearward and backward. The moving mechanism 207 of the invention comprises a motor 208, left and right linear guiding rails 209, a screw device 210 with ball screw nut, a nut for installing the ball screw 210, a slider of the left and right linear guiding rails 209 and a sliding plate 211 of the rear collimator 202. The left and right linear guiding rails 209 are fixed to the transverse frame 211 at the top of the cabinet body 201. The motor 208 is provided at an end of the left and right linear guiding rails 209. The screw shaft of the screw device 210 is rotatably coupled to the motor with a coupler. The rear collimator 202 with the correcting block is suspended at a lower part of the left and right linear guiding rails 209 by a guiding rail slider matching with the left and right linear guiding rails 209 with the sliding plate 211, and the sliding plate 211 is screwed with the ball screw 210.

The operation of moving the accelerator of the present invention is as follows:

In normal case of operating, the accelerator 200, the rear collimator 202 with the correcting block and the front collimator 203 should be lie on the same line. The rear collimator 202 with the correcting block is provided between the accelerator 200 and the front collimator 203. There is only 20 mm from the front part of the accelerator 200 to the rear collimator 202 with the correcting block, and 16 mm from the rear part of the accelerator 200 to the rear part of the cabinet body 201, saving about 500 mm repair spaces at the front and back required by the accelerator 200. The accelerator 200 is fixed to the damping device 206. In normal case of operating, the motor 208 can achieve luminance correction by moving the rear collimator 202 with the correcting block driven by the ball screw 210 on the left and right linear guiding rails 209.

In case of repairing, the motor 208 moves, by the ball screw 210, the sliding plate 211 and the rear collimator 202 with the correcting block suspended under the sliding plate 211 to the end part of the left and right linear guiding rails 209. The rear collimator 202 with the correcting block is driven to move totally away from the front of the accelerator 200 and provided outside the front and back linear guide rails 205. At this time, there is 510 mm repairing space at the front of the accelerator 200 which can satisfying the front repairing requirements of the accelerator 200. If the rear part of the accelerator 200 is repaired, the connection of the damping device 206 and the accelerator 200 can be released, and the accelerator 200 is put forward along the guiding rails 205 juxtaposed in front and back direction. At this time, there is a 526 mm inspecting space at the rear part of the accelerator 200 which can satisfying the inspecting requirements at rear of the accelerator 200.

It should be noted that, according to the technical solution of the present invention, the screw device 210, the moving mechanism 207, the guiding rails 205 juxtaposed in front and back direction etc. can be substituted with any other suitable means. For example, the screw 210 which applies screwing movement can be substituted with a hydraulic pressure oil cylinder moving mechanism driven by a hydraulic pressure oil cylinder, a gear and rack moving mechanism etc., or the linear movement of the moving mechanism 207 can be substituted with rotation along a suspending shaft of the accelerator 200, so that the rear collimator 202 with the correcting block can be totally moved away from the front of the accelerator 200, or the guiding rails 205 juxtaposed in front and back direction can be substituted with a roller. In all, all these features which could be applied to the present invention when a person normally skilled in the art reads the description of the invention fall into the protection scope of the invention.

Although an embodiment of the present invention has been shown and described, it would be appreciated by those skilled in the art that changes may be made in this embodiment without departing from the principles and spirit of the invention, the scope of which is defined in the claims and their equivalents.

What is claimed is:

1. A standing wave linear accelerator, comprising:

a microwave device configured to generate microwave;

an electron beam emitting device configured to emit electron beam;

an accelerating device configured to receive the microwave generated by the microwave device and form a microwave electric field, to accelerate electron beams generated from the electron beam emitting device and undertake the accelerated electron beam targeting to emit X ray beam;

a synchronous device configured to generate synchronous pulse signal; and a quick beam emitting device configured to receive the synchronous pulse signal generated by the synchronous device, wherein the microwave device runs and generates microwave in advance before the operation of the electron beam emitting device based on the synchronous pulse signal, and the quick beam emitting device drives the electron beam emitting device to emit electron beam after power of the microwave generated by the microwave device reaches stable state, so that the accelerating device emits X ray beam.

2. The standing wave linear accelerator according to claim 1, wherein the quick responsive beam emitting device includes a triggering controller and a pulse device between the synchronous device and the electron beam emitting device, the triggering controller receives the synchronous pulse signal emitted by the synchronous device and the enable signal of the electron beam emitting device, the pulse device generates a first high voltage pulse for triggering the electron beam emitting device to emit electron beam based on the enable signal.

3. The standing wave linear accelerator according to claim 2, wherein the pulse device comprises a pulse power supply for generating a first pulse signal based on the synchronous pulse signal; and a pulse transformer for transforming the first pulse signal generated by the pulse power supply to the first high voltage pulse.

4. The standing wave linear accelerator according to claim 1, wherein the microwave device includes a microwave pulse device, a microwave source and a microwave transferring system, the microwave pulse device receives the synchronous pulse signal of the synchronous device and generates a second high voltage pulse, the microwave source receives the second high voltage pulse and generates a microwave signal, the microwave transfer system transfers the microwave to the accelerating device to form a microwave electric field.

5. The standing wave linear accelerator according to claim 4, wherein the microwave device further comprises an AFC frequency stabilizing device configured to consist a microwave output frequency of the microwave source with a characteristic frequency of the accelerating device.

6. The standing wave linear accelerator according to claim 4, wherein the microwave source is a magnetron.

7. The standing wave linear accelerator according to claim 4, wherein the microwave pulse device comprises:

a pulse modulator for generating a second pulse signal based on the synchronous pulse signal; and a pulse transformer for transforming the second pulse signal to the second high voltage pulse.

8. The standing wave linear accelerator according to claim 1, wherein the electron beam emitting device is an electron gun.

9. A quick scan imaging inspection device comprising the standing wave linear accelerator according to claim 1.

10. An accelerator installation adjusting device, comprising:

a cabinet body;

a standing wave linear accelerator according to claim 1, provided in the cabinet body;

guiding rails arranged in parallel at both sides of the bottom in the cabinet body in an emitting direction of the accelerator radiating beam;

a damping device adjustably provided on the guide rails relaxedly and connected with the accelerator;

a moving mechanism provided at top of the cabinet body;

a rear collimator configured to be engaged with the moving mechanism and provided adjacent to the accelerator in the emitting direction of the accelerator radiating beam, so that the moving mechanism drives the rear collimator to move back and forth along the rails and the rear collimator is moved outside the rails.

11. The accelerator installation adjusting device according to claim 10, wherein further comprising:

a front collimator provided apart from the accelerator in the emitting direction of the accelerator radiating beam.

12. The accelerator installation adjusting device according to claim 10, wherein the moving mechanism comprises:

a motor;

left and right linear guiding rails installed on top of the cabinet body through a transverse frame, the motor is provided at an end of the left and right guiding rails;

a screw device, a lead screw of the screw device rotatably coupled to the motor with a coupler;

wherein the rear collimator is suspended at a lower part of the left and right linear guiding rails by a guiding rail slider matching with the left and right linear guiding rails, the guiding rail slider screwed with the lead screw device.

13. A quick beam emitting control method of a standing wave linear accelerator, comprising:

a step of starting a microwave device;

a step of forming a standing wave accelerating electric field in the accelerating device with the generated microwave; and a step of driving the electron beam emitting device to emit electron beam toward the accelerating electric field after the generated microwave power reaches stable state, so that the accelerating device emits X ray beam.

* * * * *